US010344520B2

(12) United States Patent
Burshtain

(10) Patent No.: US 10,344,520 B2
(45) Date of Patent: Jul. 9, 2019

(54) DOOR STOP

(71) Applicant: Shmuel Burshtain, Oranit (IL)

(72) Inventor: Shmuel Burshtain, Oranit (IL)

( * ) Notice: Subject to any disclaimer, the term of this patent is extended or adjusted under 35 U.S.C. 154(b) by 0 days.

(21) Appl. No.: 15/917,875

(22) Filed: Mar. 12, 2018

(65) Prior Publication Data

US 2018/0334842 A1 Nov. 22, 2018

Related U.S. Application Data

(60) Provisional application No. 62/506,626, filed on May 16, 2017.

(51) Int. Cl.
*E05F 5/02* (2006.01)
*E05F 5/08* (2006.01)

(52) U.S. Cl.
CPC ..... *E05F 5/08* (2013.01); *E05Y 2201/218* (2013.01); *E05Y 2201/46* (2013.01); *E05Y 2600/41* (2013.01); *E05Y 2600/46* (2013.01); *E05Y 2900/132* (2013.01)

(58) Field of Classification Search
CPC ... Y10T 16/61; Y10T 16/625; Y10T 16/6285; Y10T 292/11; Y10T 292/15; Y10T 292/19; E05C 17/52; E05C 17/54; E05C 17/56; E05C 17/446; E05C 19/16; E05C 19/18; E05C 19/184; E05F 5/06; E05Y 2201/20; E05Y 2201/21; E05Y 2201/218; E05Y 2201/224; E05Y 2201/46; E06B 1/045; F16B 2001/0035
See application file for complete search history.

(56) References Cited

U.S. PATENT DOCUMENTS 2,468,969 A * 5/1949 Galey ..... E05C 17/446 292/144
2,497,697 A * 2/1950 Smith ..... E05C 17/56 16/82
3,258,285 A * 6/1966 Smith ..... E05C 17/56 292/251.5
3,791,687 A * 2/1974 Schroeder ..... E05C 17/56 292/251.5
4,401,346 A * 8/1983 Jones ..... E05C 17/56 292/144

(Continued)

FOREIGN PATENT DOCUMENTS

DE 10336433 A1 * 3/2005 ..... E05C 17/56
GB 1480969 A * 7/1977 ..... E05C 17/48

(Continued)

*Primary Examiner* — Chuck Y Mah
(74) *Attorney, Agent, or Firm* — Alphapatent Associates, Ltd.; Daniel J. Swirsky

(57) ABSTRACT

A door stop, including: a top member, being fixed to the bottom of a door, the top member including a vertically movable bolt, and a spring, for lifting the bolt in relation to the door; and a bottom member, being fixed to the floor, for being disposed below the door at the stopping disposition thereof, wherein the bolt and the bottom member are characterized in bolting by magnetic attraction therebetween, being stronger than the lifting of the bolt by the spring, thereby the bolt does not protrude below the bottom of the door at the non-bolted state, thereby not requiring a gap between the door bottom and the floor.

2 Claims, 3 Drawing Sheets

STATE 1

(56) References Cited

U.S. PATENT DOCUMENTS

| | | | | |
|---|---|---|---|---|
| 6,321,411 | B1 * | 11/2001 | Ikejiri | E05C 17/56<br>16/82 |
| 8,864,188 | B2 * | 10/2014 | Redgrave | E05C 19/16<br>292/251.5 |
| 2015/0361707 | A1 * | 12/2015 | Swanberg | E05F 5/06<br>16/83 |

FOREIGN PATENT DOCUMENTS

| | | | | |
|---|---|---|---|---|
| JP | 2002038802 | A | * | 2/2002 |
| JP | 2010281179 | A | * | 12/2010 |
| JP | 2011231502 | A | * | 11/2011 |
| JP | 2012021279 | A | * | 2/2012 |

* cited by examiner

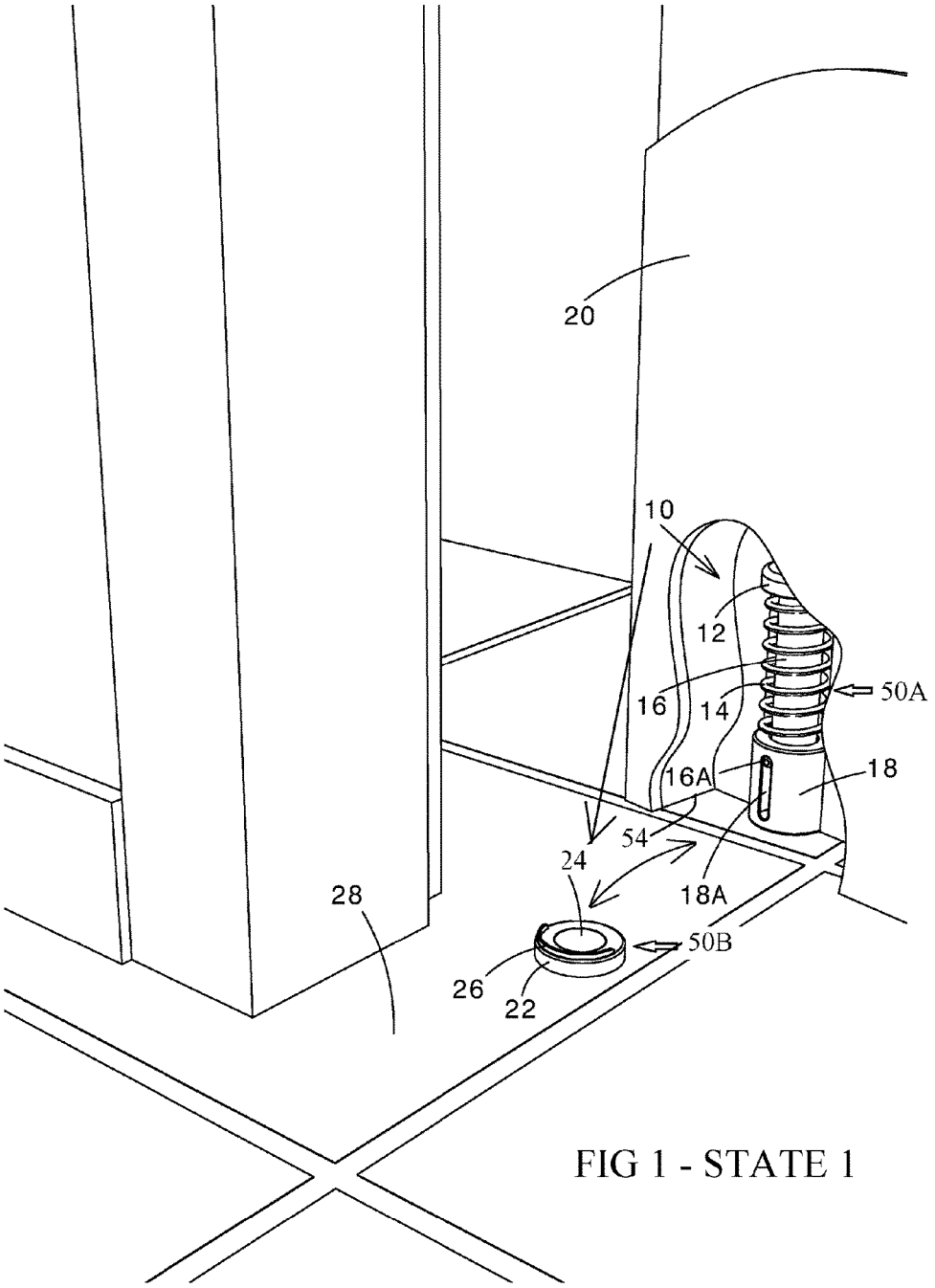
FIG 1 - STATE 1

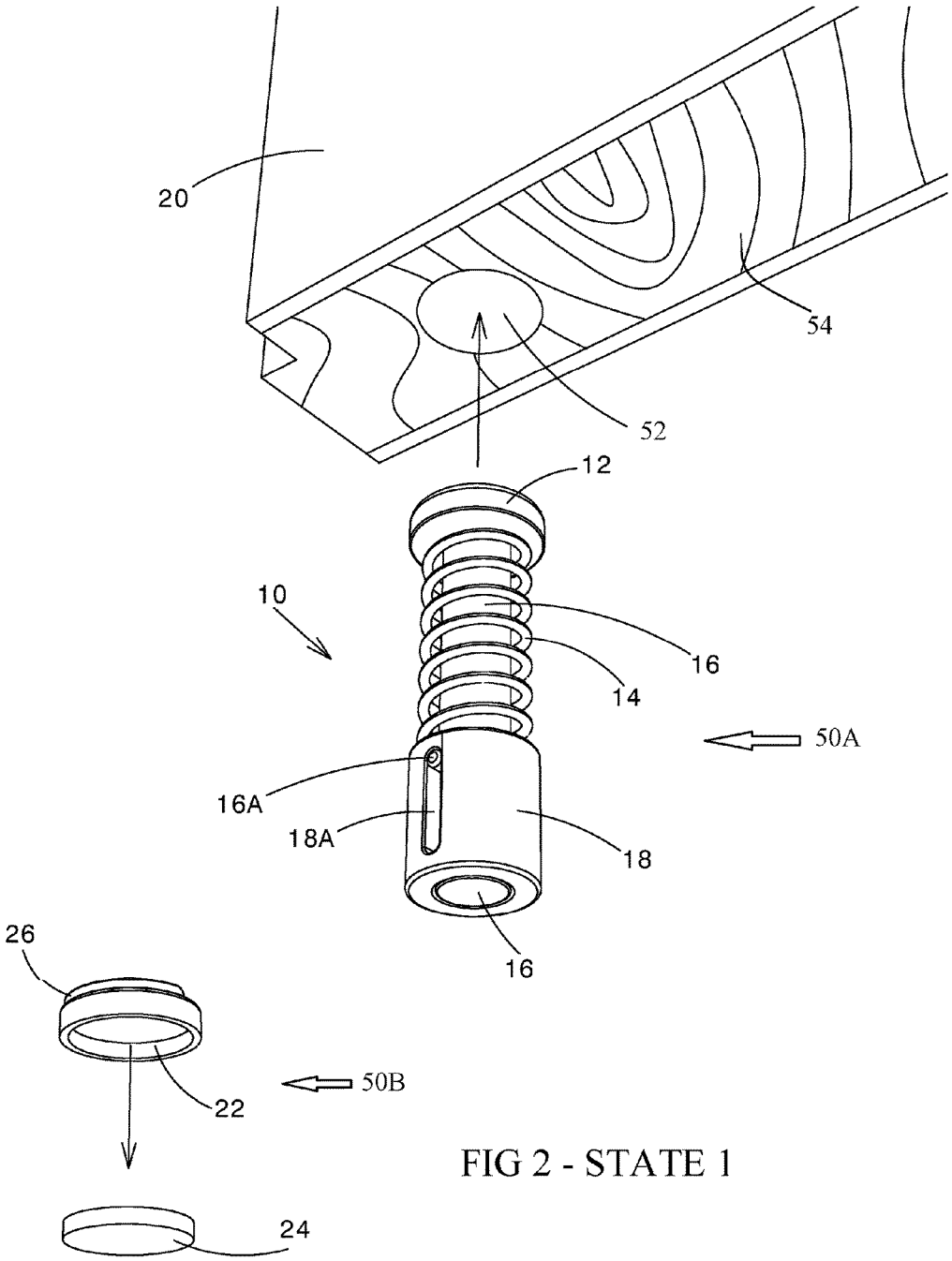
FIG 2 - STATE 1

FIG 3 STATE 2
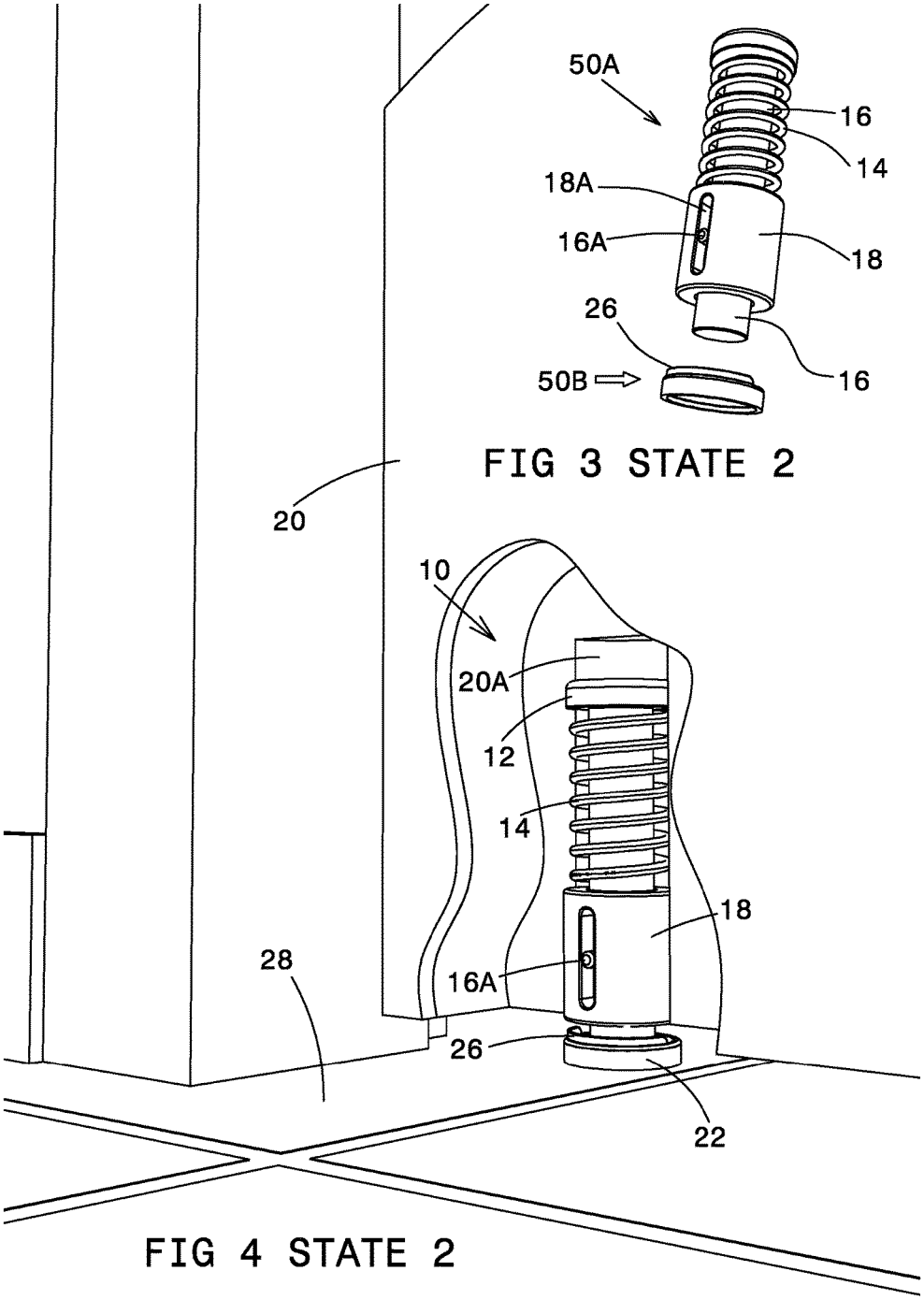
FIG 4 STATE 2

DOOR STOP

CROSS-REFERENCE TO RELATED APPLICATIONS

This application claims the benefit of priority from U.S. Provisional Application No. 62/506,626, filed May 16, 2017, the disclosure of which is incorporated herein by reference.

TECHNICAL FIELD

The invention relates to the field of door stops.

BACKGROUND

Conventional door stops are either not automatic, or require an air gap below the bottom of the door.

There is a long felt need to provide a solution to the above-mentioned and other problems of the prior art.

SUMMARY

A door stop, including:

a top member, including a vertically movable bolt; and a bottom member, wherein the bolt and the bottom member are characterized in bolting by magnetic attraction therebetween.

BRIEF DESCRIPTION OF THE DRAWINGS

Embodiments, features, and aspects of the invention are described herein in conjunction with the following drawings:

FIG. 1 depicts an installed door stop according to one embodiment of the invention, at the first state.

FIG. 2 is an exploded non-installed bottom view of the door stop of FIG. 1, at the first state.

FIG. 3 depicts the top and bottom members alone of the door stop of FIG. 1, at the second state.

FIG. 4 depicts the installed door stop of FIG. 1, at the second state.

The drawings are not necessarily drawn to scale.

DETAILED DESCRIPTION

The invention will be understood from the following detailed description of embodiments of the invention, which are meant to be descriptive and not limiting. For the sake of brevity, some well-known features are not described in detail.

The reference numbers have been used to point out elements in the embodiments described and illustrated herein, in order to facilitate the understanding of the invention. They are meant to be merely illustrative, and not limiting. Also, the foregoing embodiments of the invention have been described and illustrated in conjunction with systems and methods thereof, which are meant to be merely illustrative, and not limiting.

FIG. 1 depicts an installed door stop according to one embodiment of the invention, at the first state.

A door stop 10 according to one embodiment of the invention, includes a top member 50A, being fixed to the bottom of a door 20; and a bottom member 50B, being fixed to the floor 28.

FIG. 2 is an exploded non-installed view of the door stop of FIG. 1, at the first state.

Top member 50A includes a packaging 18, for being fixed to a depression 52 of door 20; and a bolt 16, being vertically movable in relation to packaging 18.

The material of bottom member 50B and of bolt 16 of top member 50A is magnetic and ferromagnetic, for providing attraction therebetween while being disposed near one other.

However, at the first state, depicted in FIG. 1 and FIG. 2, bolt 16 is disposed far from bottom member 50B, thus there is no attraction therebetween. At this state, a spring 14 lifts bolt 16.

FIG. 3 depicts the top and bottom members alone of the door stop of FIG. 1, at the second state.

At the second state, door 20 (of FIG. 1) is moved to a location disposing top member 50A above bottom member 50B.

The magnetic force of bolt 16 and bottom member 50B is stronger than the mechanical force of spring 14, thus the bottom of bolt 16 extends downwards, thus meeting bottom member 50B.

FIG. 4 depicts the installed door stop of FIG. 1, at the second state.

Thus, in one aspect, the invention is directed to a door stop (10), including:

a top member (50A), being fixed to the bottom of a door (20), the top member (50A) including a vertically movable bolt (16), and a spring (16), for lifting the bolt (16) in relation to the door (20); and a bottom member (50B), being fixed to the floor (28), for being disposed below the door (20) at the stopping disposition thereof, wherein the bolt (16) and the bottom member (50B) are characterized in bolting by magnetic attraction therebetween, being stronger than the lifting of the bolt (16) by the spring (16), thereby the bolt (16) does not protrude below the bottom (54) of the door (20) at the non-bolted state, thereby not requiring a gap between the door bottom (24) and the floor (28).

The door stop (10) may further include a depression (52) in the door (20), for housing the top member (50A), thereby hiding thereof.

The door stop (10) may further include a vertical extension (26), extending from the bottom member (50B), for mechanically stopping the bolt (16).

In the figures and/or description herein, the following reference numerals (Reference Signs List) have been mentioned:

- numeral 10 denotes the door stop according to one embodiment of the invention;
- numeral 12 denotes a head;
- numeral 14 denotes the spring;
- numeral 16 denotes the bolt;
- numeral 16A denotes a pin;
- numeral 18 denotes a packaging;
- numeral 18A denotes a slot;
- numeral 20 denotes the door;
- numeral 22 denotes a ring;
- numeral 24 denotes a magnetic or ferromagnetic element;
- numeral 26 denotes a vertical extension;
- numeral 28 denotes the floor;
- numerals 50A and 50B denote the top and bottom members;
- numeral 52 denotes the door depression; and
- numeral 54 denotes the bottom of the door.

The foregoing description and illustrations of the embodiments of the invention have been presented for the purpose of illustration, and are not intended to be exhaustive or to limit the invention to the above description in any form.

Any term that has been defined above and used in the claims, should to be interpreted according to this definition.

The reference numbers in the claims are not a part of the claims, but rather used for facilitating the reading thereof. These reference numbers should not be interpreted as limiting the claims in any form.

What is claimed is:

1. A door stop, comprising:

a top member, being fixed to a bottom of a door, said top member comprising a vertically movable bolt, and a spring, for lifting said bolt in relation to said door;

a bottom member, being fixed to a floor, for being disposed below said door at a stopping disposition thereof; and a vertical extension, extending from said bottom member, for mechanically stopping said bolt, wherein said fixing of bottom member to the floor is configured to dispose said vertical extension on a distal side of said bottom member away from the door, thereby said mechanical stopping of said bolt by said vertical extension comprises stopping advancement of said bolt with the door to dispose said top member above said bottom member, wherein said bolt and said bottom member are characterized in bolting by magnetic attraction therebetween, being stronger than said lifting of said bolt by said spring, thereby said bolt does not protrude below said bottom of said door at a non-bolted state.

2. A door stop according to claim 1, further comprising: a depression in said door, for housing said top member, thereby hiding thereof.

* * * * *